United States Patent [19]

Kuntz

[11] 4,028,693

[45] June 7, 1977

[54] PACE SETTING LIGHT FOR JOGGERS

[76] Inventor: Ronald W. Kuntz, 4049 56th St., Des Moines, Iowa 50312

[22] Filed: Aug. 27, 1975

[21] Appl. No.: 608,073

[52] U.S. Cl. ..... 340/323 R; 35/29 R; 272/4; 272/100

[51] Int. Cl.[2] ..... G08B 23/00; A63K 1/00

[58] Field of Search ..... 340/323 R, 43; 273/86 R, 86 B, 86 H; 35/29 R; 272/4, 57 R, 99, 100; 310/232; 198/834; 58/152 E

[56] References Cited

UNITED STATES PATENTS

| | | | |
|---|---|---|---|
| 1,602,499 | 10/1926 | Meinecke | 272/4 |
| 2,457,968 | 1/1949 | Allen et al. | 340/323 |
| 3,842,301 | 10/1974 | Smith | 310/232 |
| 3,846,704 | 11/1974 | Bessette | 340/323 |

*Primary Examiner*—John W. Caldwell
*Assistant Examiner*—James J. Groody
*Attorney, Agent, or Firm*—Zarley, McKee, Thomte & Voorhees

[57] ABSTRACT

A method and apparatus for providing a pace setting light for joggers, with the method comprising projecting a beam of light directly onto a jogging track to provide a spot of light on the track, and thereafter uniformly moving the projected spot of light around the track on the jogging surface of the track to provide a moving and pace setting spot of light. The apparatus comprises a frame having a path in the shape of the jogging track, a light beam source movably mounted on the path of said frame, power means on the frame to move the light beam source along the path, with the light beam source being electrically connected via slip rings to a source of electrical energy.

3 Claims, 5 Drawing Figures

PACE SETTING LIGHT FOR JOGGERS

BACKGROUND OF THE INVENTION

With the modern day increased emphasis upon physical fitness, more and more people have turned to jogging as a means of keeping themselves reasonably fit. Jogging has increased tremendously as a means of physical fitness improvement because of the relatively short time required for completion of the exercise, the fact that jogging can be done alone without the need for assembling a team of personnel, and the fact that jogging can be accomplished almost anywhere.

Much jogging is done on indoor tracks, particularly when the weather is not suitable for outdoor jogging. Individuals using indoor jogging tracks often desire to jog their predetermined distance within a defined period of time. For example, many joggers set as a goal an 8-minute mile. To attain a 8-minute mile, the jogger must maintain a relatively constant pace of jogging each quarter mile in about two minutes. While some joggers utilize a stop watch in order to pace themselves and to accomplish their desired objective of reaching their predetermined distance in a set period of time, this has often proved unhandy. One of the disadvantages of carrying a stop watch is the very fact that the jogger must in fact carry the stop watch with him while jogging. In addition, the stop watch must be read during the jogging activity in order to determine whether or not the jogger is in fact keeping at or near his desire pace. Moreover, as is known by anyone who has ever jogged, it is not easy to read a stop watch while jogging. In addition, it is often easy for a jogger to forget the number of laps he has jogged around the track. There is, therefore, a need for a convenient means for joggers to pace themselves.

The object of this invention is to satisy the need of joggers for a convenient method of pacing themselves. In particular, an object of this invention is to provide a means for joggers to pace themselves which does not interfere with the jogging track or obstruct the use of the jogging track.

Another object of this device is to provide a means of pacing joggers which projects a light directly onto the jogging track and uniformly moves that light along the jogging surface of the track to provide a pace setting spot of light.

Yet another object of this invention is to provide a pace setting spot of light on a jogging track which moves at a designated predetermined rate of speed in order to pace the jogger.

Yet another object of this invention is to provide a pace setting device for joggers which has an associated timer switch which stops the movement of the beam of light around the jogging surface after the spot of light has moved a predetermined number of movements along the jogging path.

The method of accomplishing these and other objects will become apparent from the detailed description of the invention. as follows.

BRIEF DESCRIPTION OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings in which:

DETAILED DESCRIPTION OF THE INVENTION

Figure 1:
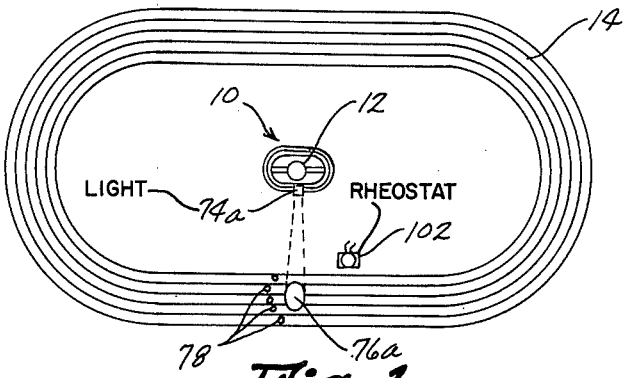
FIG. 1 is a plan view showing the device of this invention in use as it projects a beam of light on a jogging track.
Figure 5:
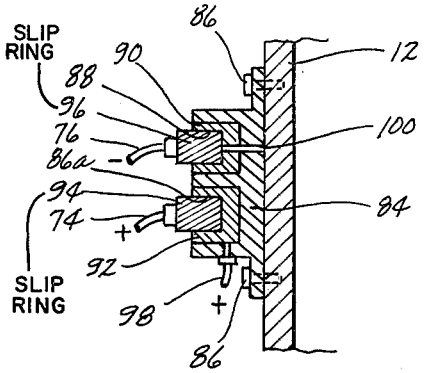
FIG. 5 is a sectional view of FIG. 2 along line 5—5 showing the constructional details of the conductive slip rings utilized to provide a source of electrical energy to the light source for the jogging device of the present invention.

The jogging device 10, as depicted herein for exemplary purposes, is mounted upon a support pole 12 centrally positioned at the point of intersection of the major axis and the minor axis of an oval track 14. A frame or rail 16 is provided which is of the same geometric configuration as the track except of course that it is much smaller than the track. Frame 16 has a cross support bar 18 extending from frame 16 to the central support pole 12. In like manner support bar 20 which is only partially depicted in FIG. 2, extends from the side of track of frame 16 opposite support bracket 18 to the central support pole 12. Support brackets 18 and 20 can be mounted to the central support pole 12 by conventional means such as a bolt and nut or the like. Track or frame portion 16 has on its top surface a path 22 which corresponds exactly in shape with the jogging path of the jogging track 14. Of course, if desired, the track or frame portion 16 can be variably adjustable to provide adjusting of its dimensions for larger or smaller jogging tacks. This can easily be accomplished by providing movable track or rail portions, one matingly received in the other and a means for sliding one with respect to the other to increase or decrease the length of the major axis of the track or frame portion 16.

Track or frame portion 16, for purposes of description, will be discussed in terms of having an interior perimeter edge surface 24, and an exterior perimeter edge surface 26.

Figure 4:
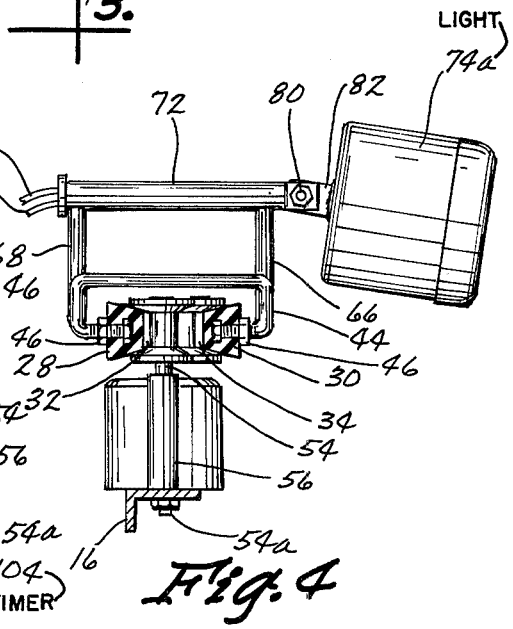
FIG. 4 is an elevated view aong line 4—4 of FIG. 3 showing the constructional details of the light source and its relationship to the conveyor track of the jogging device of this invention.

As best seen in FIG. 4, the frame 16 has a plurality of spaced apart roller support rods 54 bolted **54*a* to frame 16 and extending upwardly. Sleeve 56 holds idler rollers 3, 38, 40 and 42 in position, with the rollers being rotatable on the support rods. Idler rollers 36 and 38 are mounted to support an interior belt 28, and idler rollers 40 and 42 are mounted to support an exterior belt 30**. While only four rollers have been mentioned, it is understood that spaced apart rollers extend around the entire track.

Interior belt 28 is matingly received in the roller portion **36*a* of idler roller 36 and in like manner with roller 38, and so on around the track above and parallel to the interior perimeter edge surface 24 of track 16**.

Exterior belt 30 in like manner extends above and parallel to exterior perimeter edge surface 26 of track 16. Interior belt 28 and exterior belt 30 are movable around the track defined by frame 16. Interior belt 28 and exterior belt 30 also have inwardly presented toothed surfaces 32 and 34. As previously mentioned, idler rollers 36 and 38 are rotatably mounted to the track 16 and engage the interior surface of interior belt 28 to provide for easy movement of interior belt 28 around the track 16. In like manner, idler rollers 40 and 42 are rotatably mounted to frame 16 near the exterior perimeter edge surface 26 in order to provide engagement between the rolling surface of idler rollers 40 and 42 and the interior surface of exterior belt 30. It will be appreciated, of course, that a plurality of idler rollers 36 ad 38 along the interior edge portion 24 and a plurality of idler rollers 40 and 42 along the exterior edge portion 26, are utilized in order to provide less resistance to movement of interior belt 28 and exterior belt 30 along the track 16.

Figure 2:
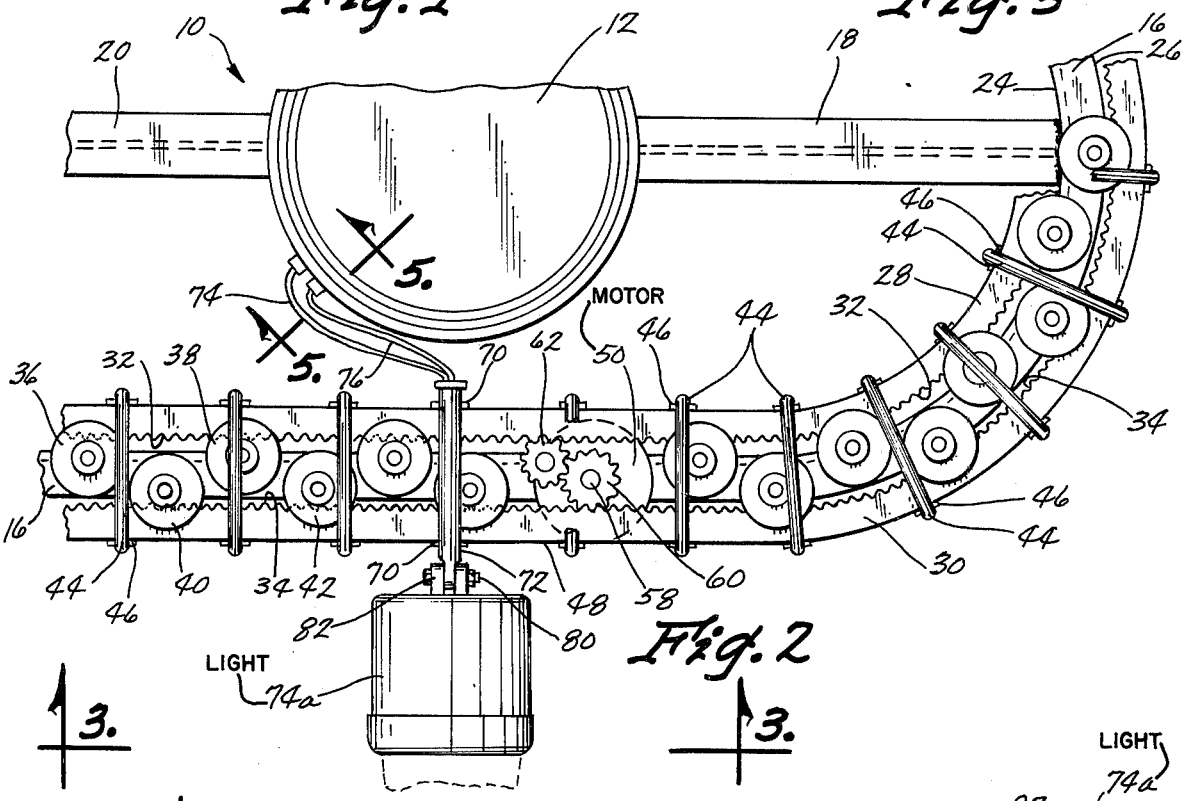
FIG. 2 is a plan view, with certain parts broken away, of the device of this invention setting forth in detail the constructional aspects thereof.
Figure 3:
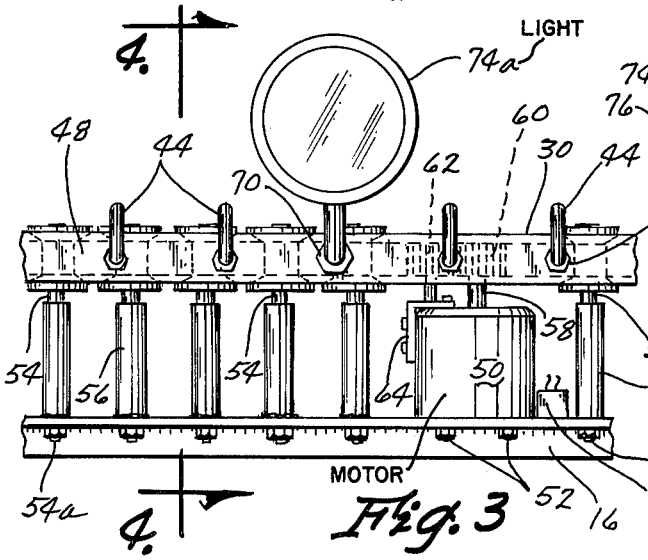
FIG. 3 is an elevated view of the device of FIG. 2 along line 3—3.

Bracket 44 is secured by convention fastening means 46 to the exterior side surface 48 of exterior belt 30 across the upper surface of the idler rollers and belts downwardly and inwardly secured to the inwardly presented exterior surface of interior belt 28. In this manner, interior belt 28 and exterior belt 30 are secured to the track portion defined by the idler rollers and are assured of moving in unison around the track extending over frame portion 16. As depicted in FIG. 2, a plurality of brackets 44 are spaced apart around the track or frame portion 16.

A conventional motor power means 50 is mounted by conventional fastening means 52 to frame portion 16. Extending upwardly from motor 50 is power shaft 58. Power shaft 58 has gear 60 secured thereto for rotary movement with power shaft 58. Gear 60 meshes with toothed surface 34 of the exterior belt 30 and upon rotation of power shaft 58 upon operation of motor 50, moves exterior belt 30 around and parallel to the track 16. Gear 60 also meshes with rotatably movable gear 62 which is mounted on motor 50 by conventional means 64. Rotation of gears 60 causes rotary movement in the opposite direction of meshed gear 62. Gear 62 is meshed to the surface 32 of interior belt 28, and upon operation of motor 50 causes movement of interior belt 28 around the track over frame 16. Upstanding bracket portions 66 and 68 are secured by conventional fastening means 70 to the exterior side surfaces of belts 30 and 28, respectively. Bracket portion 72 extends from the upstanding end of bracket 66 to the upstanding end of bracket 68 ad is rigidly secured thereto. Bracket 72 has a passageway therein for electrical conductive wires 74 and 76. Secured to the outwardly presented end of bracket 72 is a light designated generally as 74*a*. Light 74*a* can be a conventional spotlight or the like utilizing a conventional parabolic reflecting surface and an intense light centrally positioned therein. Light source 74*a* can have a variety of lenses for adjustment of the size, color and shape of a light spot 76*a* projected thereby directly onto a jogging track 14. Thus, if desired, the light source 74*a* may project a circular spot of light on the track surface 14 which is white in color, or any other suitable color by use of a colored lense, or a suitable light shaping lense cover be utilized to project a line entirely across the track surface 14 transverse to the direction of movemet of joggers 78 along the track. Light 74*a* is pivotally mounted to bracket 72 by bolt 80 which extends through light brackets 82 and the end of outer passageway bracket 72. Thus, light 74*a* can be pivoted transversely to the axis formed by bolt 80 to control the exact position of light spot 76*a* on track 14.

Mounted to pole 12 by conventional bolts 86 is bracket 84. Bracket 84 has therein U-shaped openings 86*a* and 88. Mounted within the openings defined by U-shaped openings 86*a* and 88 are brass liners 90 and 92. Matingly received in brass liners 90 and 92 are conductive slip rings 94 and 96. Conductive slip rings 94 and 96 are freely slidable with respect to brass liners 90 and 92 and can thus be freely rotated about the longitudinal axis of center support pole 12. Conductive slip ring 94 is connected via wire 98 to a source of electrical energy. The electrical energy is conveyed from wire 98 to brass liner 92 to slip ring 94 and from slip ring 94 to electrical wire 74 which is electrically connected thereto. In like manner, ground wire 76 is electrically connected to conductive slip ring 96 which is in electrical contact with ground 100.

In actual operation, the device of this invention operates as follows: Motor 50 is turned on and power shaft 58 rotates gear 60. Gear 60, since it meshes with toothed surfaces 34 of exterior belt 30, causes movement of exterior belt 30 above frame 16 parallel to the exterior perimeter edge surface 26. In like manner, rotational gear 60 causes rotation in the opposite direction of meshed gear 62, and since gear 62 is meshed with the toothed surface 32 of interior belt 28, this causes movement in the same direction by belt 28 as the movement of interior belt 30. Light 74*a*, which is secured to interior and exterior belts 28 and 30, respectively, is moved along path 22 around the frame. Idler rollers 38 and 40 and 42 reduce the friction between belts 28 and 30 and frame 16. Electric wires 74*a* and 76 are pulled tight as light 74 is moved and cause imparted rotational movement to conductive slip rings 94 and 96. Of course, wires 74 and 76 are of sufficient length to span the widest portion of the distance between conductive slip rings 94 and 96 and track 16. Electical energy is conveyed from electrical energy source wire 98 through conductive slip ring 94 to light source 74*a*. Light source 74*a* projects a light spot 76*a* which is moved directly on the jogging surface of jogging track 14.

In actual operation, the number of revolutions per given period of time of light 74*a* on top surface path defined by frame 16 can be controlled by a rheostat 102 which can be turned upward or downward to control the rate of revolution of shaft 58 of motor 50.

In addition, a timer or shutoff switch 104 can be associated with motor 50 in order to stop the rotational movement of light 74*a* after a predetermined number of revolutions around path 24. Finally, if desired, a projecting finger can extend downwardly from track 24 to contact a counter once upon each revolution in order to count the number of successive revolutions made by light 74*a*. As will also be appreciated, it is also possible that light 74*a* could be operated by a battery power source rather than utilization of conductive slip rings. In addition, light from one source could be shined onto reflectors which are thereafter moved around the track or frame 16 to reflect the light from a constant source directly onto the track.

It should be noted that certain advantages which appear with this invention are that the light beam is projected directly onto the jogging surface without any interfering physical obstacles. In addition, the projected light spot is uniformly moved around the track at a rate of speed which is controllable, to vary the pace provided for persons jogging on the track. In addition, the orientation of the spot of light 76*a* can be varied in accord with the preferences of the persons jogging on the track from, for example, a circular spot to a uniform forward moving line. Thus, as can be seen, the invention accomplishes at least all of its stated objects.

What is claimed is:

1. A device for projecting a moving spot of light onto a jogging track comprising, a frame corresponding to the shape of said jogging track, power means mounted to said frame, said power means having a power take-off shaft, a power gear mounted on said power take-off shaft of said power means, a first continuous flexible toothed belt meshed with said power gear for constant velocity driven movement thereby, a driving gear meshed with said power gear, a second continuous flexible tooth belt meshed with said driven gear for constant velocity movement therewith, said first and second flexible toothed belts being in parallel spaced apart relationship above said frame, and corresponding to the shape of said frame, means extending upwardly from said frame to support said first and second flexible toothed belts in said parallel spaced apart relationship, a light beam source in secured relationship to said first and second toothed belts for constant velocity movement with said belts when said belts are driven, said light beam source being electrically connected to a source of electrical energy.

2. The device of claim 1 wherein the electrical connection of said light beam source to a source of electrically energy is by an electrically conductive slip ring.

3. The device of claim 1 wherein said light source has means to vary the shape of said spot of light projected on said track.

* * * * *